United States Patent [19]

Soes

[11] 4,277,663

[45] Jul. 7, 1981

[54] ELECTRICAL SWITCH

[75] Inventor: Lucas Soes, Rosmalen, Netherlands

[73] Assignee: AMP Incorporated, Harrisburg, Pa.

[21] Appl. No.: 126,799

[22] Filed: Mar. 3, 1980

[30] Foreign Application Priority Data

Mar. 10, 1979 [GB] United Kingdom ..... 08507/79
Sep. 26, 1979 [GB] United Kingdom ..... 33244/79

[51] Int. Cl.[3] ..... H01H 15/24; H01H 3/42

[52] U.S. Cl. ..... 200/283; 200/284; 200/153 LA; 200/6 BB

[58] Field of Search ..... 200/283, 245, 246, 284, 200/153 LA, 5 A, 6 BB, 6 C, 153 LB

[56] References Cited

U.S. PATENT DOCUMENTS

| | | | |
|---|---|---|---|
| 3,249,725 | 5/1966 | Hutt et al. | 200/153 LA |
| 3,849,610 | 11/1974 | Lockard et al. | 200/153 LA |
| 3,944,760 | 3/1976 | Zdanys et al. | 200/6 BB |
| 4,012,608 | 3/1977 | Lockard | 200/16 D |
| 4,081,632 | 3/1978 | Schäffeler | 200/284 |
| 4,092,504 | 5/1978 | Kotaka | 200/16 D |
| 4,132,874 | 1/1979 | Bruni et al. | 200/16 F |

*Primary Examiner*—Willis Little
*Attorney, Agent, or Firm*—David C. Ripma

[57] ABSTRACT

An electrical switch comprises a housing (1) carrying a first, fixed contact (3) and a second, movable contact (6) in the form of a resilient contact arm secured to the housing (1) at one end. The resilient contact arm comprises a single inner limb (9) and two outer limbs (10, 11) one of which is engaged by the actuator member (15) and the other of which engages the fixed contact (3) on operation of the actuator member. The housing (1) is preferably of one-piece construction, the actuator member (15) being retained in the housing (1) by a part of the second contact (6).

10 Claims, 7 Drawing Figures

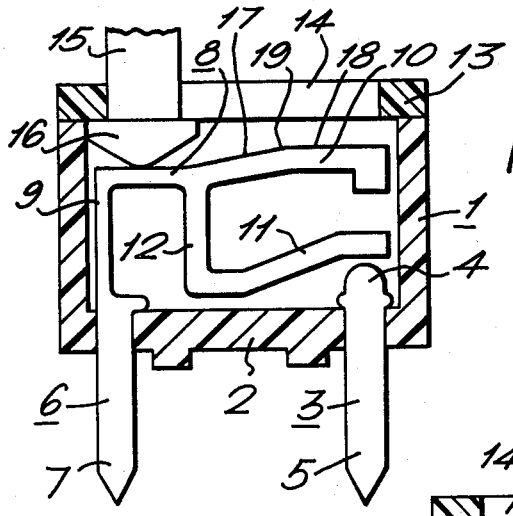
FIG.1.
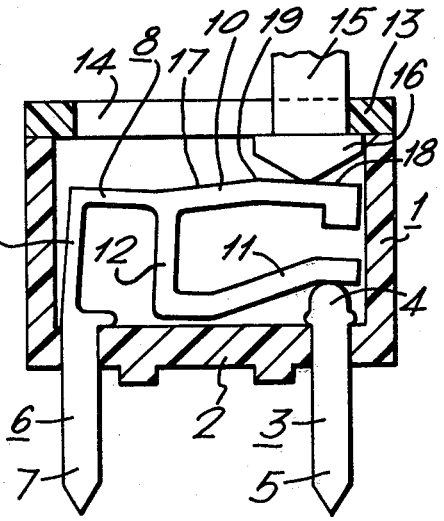
FIG.2.
FIG.3.
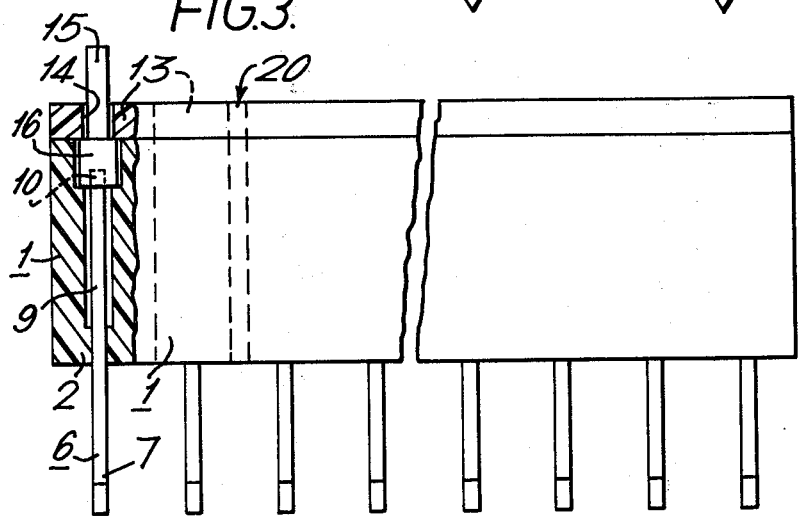

ELECTRICAL SWITCH

This invention relates to an electrical switch.

Many forms of electrical switch are known, and a common form comprises a housing carrying a first, fixed contact and a second, movable contact in the form of a resilient contact arm secured to the housing at one end, and an actuator member mounted on the housing and operable to urge the resilient contact arm from a first position out of engagement with the fixed contact into a second position in engagement with the fixed contact.

In such known switches the actuator member can be a push-button, a slider member or a rotary member, being mounted on the housing in dependence upon its particular manner of operation.

Whatever the manner of operation of the actuator member, it is desirable for the actuator member to be easily operable, and for there to be a high contact force between the fixed and movable contacts in the closed condition of the switch. However, the design of known electrical switches often makes it impossible to achieve both of these desired properties in a single switch.

According to this invention in an electrical switch comprising a housing carrying a first, fixed contact and a second, movable contact in the form of a resilient contact arm secured to the housing at one end, and an actuator member mounted on the housing and operable to urge the resilient contact arm from a first position out of engagement with the fixed contact into a second position in engagement with the fixed contact, the resilient contact arm extends from its end secured to the housing as a single inner limb and then divides into two outer limbs one of which is engaged by the actuator member and the other of which engages the fixed contact on operation of the actuator member, the arrangement being such that an operation of the actuator member, initially the whole resilient contact arm deflects by bending of the single inner limb until said other outer limb engages the fixed contact whereafter the two outer limbs of the resilient contact arm are deflected towards each other thereby to increase the contact force between said other outer limb and the fixed contact.

In the switch of this invention ease of operation of the actuator member is achieved in that initially the whole resilient contact arm is deflected by bending of the single inner limb thereof, this bending offering little resistance to movement of the actuator member, while a high final contact force is achieved by the subsequent movement of the two outer limbs of the resilient contact member towards each other while one limb is in contact with the fixed contact.

Electrical switches according to this invention will now be described by way of example with reference to the drawings, in which:

FIG. 1 is a diagrammatic sectional view through a first switch in a first condition;

FIG. 2 is a view similar to FIG. 1 but with the first switch in a second condition;

FIG. 3 is a diagrammatic sectional view through the first switch at right angles to the views of FIGS. 1 and 2;

Figure 4:
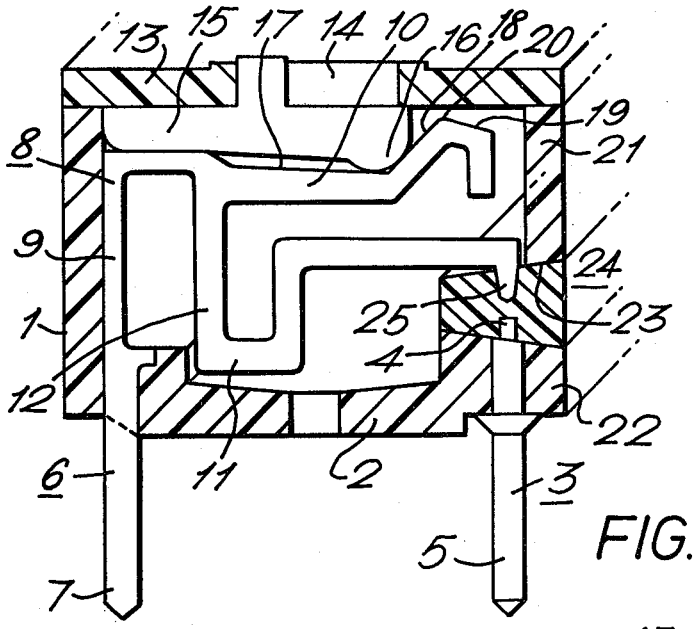
FIG. 4 is a view similar to FIG. 1 but through a second switch.

The switch shown in FIGS. 1 to 3 comprises a housing 1 moulded from electrically insulating plastics material in the form of an open rectanguloid box. The base 2 of the housing 1 carries a first fixed metal contact 3 having a contact head 4 located within the housing 1, and a pin portion 5 projecting from the base 2 of the housing 1 for receipt, for example, in a hole in a substrate such as a printed circuit board (not shown). Also secured to the base 2 is a second contact 6 stamped and formed from resilient sheet metal, and having a pin portion 7 projecting from the base 2 similarly to and spaced from the pin portion 5 of the fixed contact 3, and having within the housing 1 a movable resilient contact arm 8. The contact arm 8 comprises a single inner L-shaped limb 9 extending from the pin portion 7, which inner limb 9 divides into two outer limbs 10 and 11 joined by a cross limb 12 to give a U-shape.

The housing 1 is closed by a cover 13 having a slot 14 therein, and an actuator member 15 is positioned in the slot 14 for movement from a first position, shown in FIG. 1, in which a head 16 of the actuator member 15 located within the housing 1 is positioned substantially over the pin portion 7 of the second contact 6, and a second position, shown in FIG. 2, in which the head 16 is positioned substantially over the fixed contact 3. The top, outer part of the actuator member 15 is shown broken away, but can be of any convenient form suitable for effecting the necessary sliding movement of the actuator member 15 along the slot 14 between the two positions described.

As clearly shown in FIG. 1, the upper (as seen in the drawings) outer limb 10 of the contact arm 8 presents an outer edge which has a first portion 17 which slopes from the end of the inner arm 9 towards the cover 13, and a second portion 18 which extends parallel to the cover 13 (and thus to the base 2), to the free end of the limb 10.

In the first condition of the switch shown in FIG. 1, the head 16 of the actuator member 15 is resting on the inner limb 9 of the contact arm 8, the lower outer limb 11 is out of contact with the fixed contact head 4, and the resilient contact arm 8 is unflexed.

As the actuator member 15 is slid along the slot 14 towards the second position shown in FIG. 2, the head 16 engages the first portion 17 of the edge of the upper outer limb 10 of the contact arm 8, and initially the whole contact arm 8 is resiliently deflected by bending of the inner limb 9 until the lower outer limb 11 comes into engagement with the head 4 of the fixed contact 3. (FIG. 2 shows the inner limb 9 in this flexed condition). Thereafter, further movement of the head 16 along the edge portion 17 causes the two outer limbs 10 and 11 of the contact arm 8 to be resiliently deflected towards each other, thereby to increase the contact force between the lower outer limb 11 and the head 4 of the fixed contact 3.

The head 16 then passes over the ridge 19 between the edge portions 17 and 18 of the upper outer limb 10 and passes on to the edge portion 18 which, due to the bending of the inner limb 9 is now sloping away from the cover 13 in the direction away from the ridge 19, as shown in FIG. 2, until the switch is in a second condition as shown in FIG. 2 in which electrical connection between the post portions 5 and 7 of the contacts 3 and 8 is maintained.

Due to the above described manner of operation of the switch, an over-centre action is achieved for the actuator member 15 giving a user a positive feel indicating correct operation of the switch. The resistance to movement of the actuator member 15 felt by a user increases as the head 16 passes along the edge portion 17 of the upper outer limb 10 until the head 16 passes over the ridge 19 whereafter the force decreases again as the head 16 passes along the edge portion 18 of the upper outer limb 10.

The maximum contact force between the lower outer limb 11 and the head 4 of the fixed contact 3, and the maximum deflection of the outer limb 10 and 11 towards each other, occurs as the head 16 of the actuator member 15 passes over the ridge 19, after which the outer limbs 10 and 11 relax slightly. This action causes a slight beneficial sliding action between the lower outer limb 11 and the head 4 of the fixed contact 3.

A similar over-centre action is felt as the actuator member 15 is returned to the first position shown in FIG. 1, the lower outer limb 11 coming out of contact with the head 4 of the fixed contact 3 during this movement.

As shown in FIG. 3, the housing 1 and cover 13 can be moulded together with a plurality of similar structures in strip form whereby a multiple switch can be produced. Preferably adjacent housings and covers are separated by a line of weakness 20 whereby a single or strip of any required number of housings and covers can be broken from a longer strip.

Figure 5:
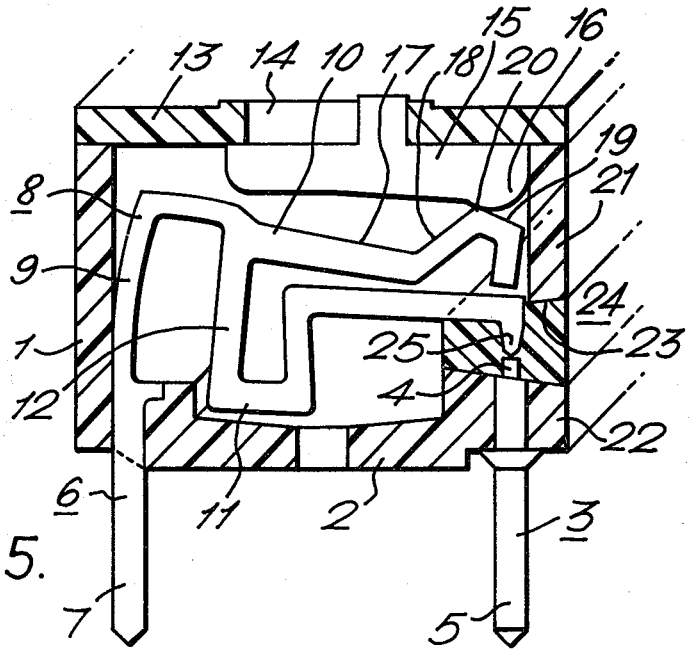
FIG. 5 is a view similar to FIG. 2 but through the second switch.

Referring now to FIGS. 4 and 5, the switch here shown is similar to that shown in FIGS. 1 to 3, and corresponding parts have the same reference numerals.

In the switch shown in FIGS. 1 and 2 the area of contact between the fixed contact 3 and the resilient contact arm 11 is exposed to the surrounding atmosphere, and while this may normally be acceptable, there are occasions when it is desirable for the contact area to be protected from the surrounding atmosphere, the switch then being a so-called gas-tight switch.

Thus, in the switch shown in FIGS. 4 and 5, the wall 21 of the housing 1 adjacent the fixed contact 3 is formed with a thickened portion 22 through which the fixed contact 3 extends, and with a slot 23 which receives a body 24 of resilient electrically insulating material. The body 24 is received in the slot 23 on the surface of the thickened portion 22 of the wall 21, and envelopes both the contact head 4 of the fixed contact 3, and also the contact head 25 of the lower outer limb 11 of the contact arm 8. The body 24 can be pre-formed and mounted on the housing 1 prior to mounting of the contacts 3 and 8 thereon, or the body 24 can be formed in situ on the housing 1 by, for example, injection of a room-temperature curing paste, or by a moulding operation, either before or after the contacts 3 and 8 are mounted thereon.

On first operation of the switch from the condition of FIG. 4 to that of FIG. 5 the contact head 25 of the outer limb 11 is urged through the material of the body 24, and the contact head 25 is therefore preferably sharp to facilitate such penetration. On return of the switch to the condition of FIG. 1 the material of the body 24 relaxes to fill the space between the contact heads 4 and 25, thereby retaining the sealing of the contact position at all times.

The switch shown in FIGS. 4 and 5 can be part of a multiple switch arrangement, as shown in FIG. 3, formed from a plurality of such switches arranged in a row with their housings 1 integrally formed, in which case the body 24 of resilient electrically insulating material can be a single body common to all of the switches of the row.

Figure 6:
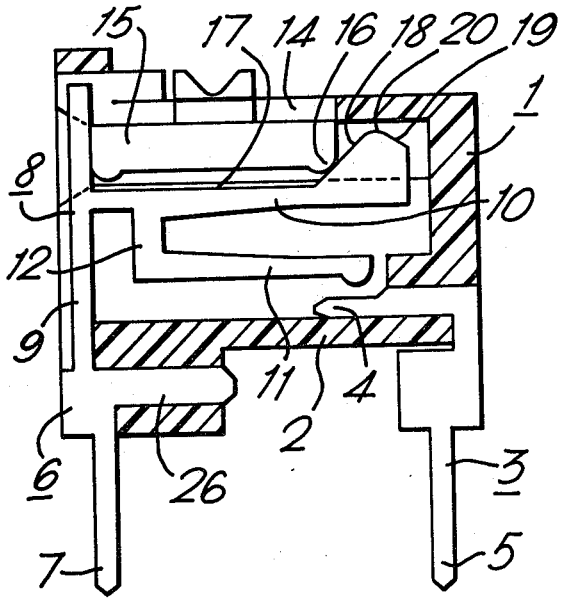
FIG. 6 is a view similar to FIG. 1 but through a third switch.

Referring now to FIG. 6, the switch here shown is similar to that shown in FIGS. 1 and 2, and corresponding parts have the same reference numbers.

The essential differences between the switch of FIG. 6 and that of FIGS. 1 and 2 are that in the switch of FIG. 6 the housing 1 is of one-piece construction, not having a separate lid (13) as used in FIGS. 1 and 2, and that the actuator member 15 in FIG. 6 is retained in the housing 1 by an extension of the single inner limb 9 of the resilient contact 6. The fixed contact 3 is also mounted differently in that it is inserted from the side rather than from the bottom of the housing. The housing 1 can thus be moulded in one piece, with all the necessary cores moving horizontally of the housing 1 as seen in the drawing.

The housing 1 is open to one side (left-hand side in FIG. 6) and the actuator member 15 is introduced into the housing from this side. The contact 6 is then mounted on the housing 1 from the open side thereof, the extension on the single inner limb 9 of the contact 6 engaging behind the actuator member 15 which is thus retained in the housing 1 thereby.

Figure 7:
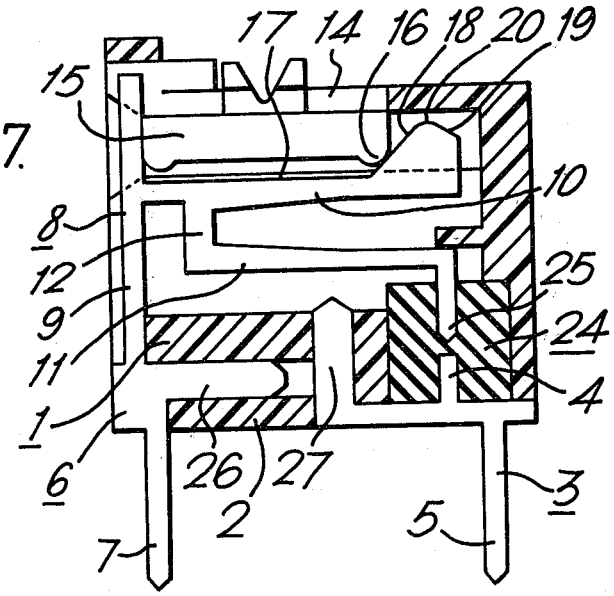
FIG. 7 is a view similar to FIG. 1 but through a fourth switch.

Referring now to FIG. 7, the switch here shown is similar to that shown in FIG. 6, but includes a body 24 of resilient electrically insulating material as shown in the switch of FIGS. 4 and 5. The housing 1 is again of one-piece construction, with the actuator member 15 being retained in place by the contact 6.

The switches of FIGS. 6 and 7 have the advantage that they are easy to manufacture and assemble, and are thus relatively cheap, while still retaining the advantages of the switches of FIGS. 1 and 2, or FIGS. 3 and 4 respectively.

What is claimed is:

1. An electrical switch comprising a housing carrying a first, fixed contact and a second, movable contact in the form of a resilient contact arm secured to the housing at one end, and an actuator member mounted on the housing and operable to urge the resilient contact arm from a first position out of engagement with the fixed contact into a second position in engagement with the fixed contact, the actuator member being retained in the housing by a part of the second contact, in which the resilient contact arm extends from its end secured to the housing as a single inner limb and then divides into two outer limbs one of which is engaged by the actuator member and the other of which engages the fixed contact on operation of the actuator member, the arrangement being such that on operation of the actuator member, initially the whole resilient contact arm deflects by bending of the single inner limb until said other outer limb engages the fixed contact whereafter the two outer limbs of the resilient contact arm are deflected towards each other thereby to increase the contact force between said other outer limb and the fixed contact.

2. An electrical switch as claimed in claim 1, in which the housing carries a body of resilient electrically insulating material in which the contact points of the fixed contact and said other outer limb of the resilient contact arm are embedded, the arrangement being such that on operation of the actuator member the contact point of said other outer limb is urged through the material of the body into contact with the contact point of the fixed contact.

3. An electrical switch as in claim 1 in which the housing is of one-piece construction, and the actuator member is mounted on the housing for sliding movement relative thereto.

4. An electrical switch comprising a housing carrying a first, fixed contact and a second, movable contact in the form of a resilient contact arm secured to the housing at one end, and an actuator member mounted on the housing and operable to urge the resilient contact arm from a first position out of engagement with the fixed contact into a second position in engagement with the fixed contact, in which the resilient contact arm extends from its end secured to the housing as a single inner limb which is substantially L-shaped and then divides into two outer limbs one of which is engaged by the actuator member and the other which engages the fixed contact on operation of the actuator member, the arrangement being such that on operation of the actuator member, initially the whole resilient compact arm deflects by bending of the single inner limb until said outer limb engages the fixed contact whereafter the two outer limbs of the resilient contact arm are deflected towards each other thereby to increase the contact force between said outer limb and said fixed contact.

5. An electrical switch as in claim 4 in which during movement of the actuator member, deflection of the two outer limbs of the resilient contact arm towards each other passes through a maximum and then decreases whereby an overcentre action for the actuator member is achieved.

6. An electrical switch comprising a housing carrying a first, fixed contact and a second, movable contact which includes three limbs, an inner limb which is secured to the housing and two outer limbs joined to said inner limb within the housing, and an actuator member mounted on the housing and operable to engage and urge against one of said outer limbs of said second movable contact to responsively move the other of said outer limbs from a first position out of engagement with the fixed contact into a second position in engagement with the fixed contact whereby a circuit is completed, said two outer limbs forming generally a U-shape and said actuator member being movable along the edge of said one outer limb wherein said actuator member initially bends both outer limbs together until said other outer limb engages the fixed contact, after which said actuator member is movable further along the edge of said one outer limb to urge said one outer limb towards said other outer limb thereby to increase the contact force between said other outer limb and the fixed contact.

7. An electrical switch as in claim 6 in which the actuator member is retained in the housing by a part of the second contact.

8. An electrical switch as in claim 6 in which the housing carries a body of resilient electrically insulating material in which the contact points of the first fixed contact and said other outer limb of said second movable contact are embedded, the arrangement being such that on operation of the actuator member the contact point of said other outer limb is urged through the electrically insulating material into contact with the contact point of the fixed contact.

9. An electrical switch as in claim 6 in which during movement of the actuator member deflection of said one outer limb towards said other outer limb passes through a maximum deflection and then decreases whereby an overcenter action for the actuator member is achieved.

10. An electrical switch as in claim 6 in which said inner limb of said second movable contact is substantially L-shaped.

* * * * *